US010074353B2

(12) United States Patent
Cook et al.

(10) Patent No.: US 10,074,353 B2
(45) Date of Patent: Sep. 11, 2018

(54) SELF-POWERED LOUDSPEAKER FOR SOUND MASKING

(71) Applicant: Cambridge Sound Management, Inc., Waltham, MA (US)

(72) Inventors: Gordon V. Cook, Acton, MA (US); Mitchell Nollman, Brighton, MA (US)

(73) Assignee: Cambridge Sound Management, Inc., Waltham, MA (US)

( * ) Notice: Subject to any disclaimer, the term of this patent is extended or adjusted under 35 U.S.C. 154(b) by 0 days.

(21) Appl. No.: 15/598,528

(22) Filed: May 18, 2017

(65) Prior Publication Data

US 2017/0337916 A1 Nov. 23, 2017

Related U.S. Application Data

(60) Provisional application No. 62/339,417, filed on May 20, 2016.

(51) Int. Cl.
*H04R 3/02* (2006.01)
*G10K 11/175* (2006.01)
(Continued)

(52) U.S. Cl.
CPC ..... *G10K 11/175* (2013.01); *H04R 1/403* (2013.01); *H04R 3/12* (2013.01); *H04R 9/06* (2013.01); *H04R 2201/028* (2013.01)

(58) Field of Classification Search
CPC ..... G10K 11/175; H04R 1/403; H04R 3/12; H04R 9/06; H04R 2201/028
See application file for complete search history.

(56) References Cited

U.S. PATENT DOCUMENTS 4,185,167 A 1/1980 Cunningham et al.
4,438,526 A 3/1984 Thomalla
(Continued)

FOREIGN PATENT DOCUMENTS

CA 2634268 12/2009
GB 2235349 2/1991
(Continued)

OTHER PUBLICATIONS

Taylor, Ashton. "Sound masking systems." Report to Atlas Sound, Hoover & Keith Inc., pp. 1-56 (2000).
(Continued)

*Primary Examiner* — Andrew L Sniezek
(74) *Attorney, Agent, or Firm* — Hamilton, Brook, Smith & Reynolds, P.C.

(57) ABSTRACT

A sound masking system includes a self-amplified loudspeaker emitter unit, with a driver and enlarged ported enclosure, sufficient to provide a frequency range down to a low frequency, such as about 125 Hz. To deliver the power, the power distribution architecture includes audio power amplifiers in the emitter housing of each loudspeaker. Raw power is delivered to each emitter unit through a cable and connectors, such as an Ethernet cable and connectors, in the same cable with the sound masking and audio signals. Inside the emitter units are electronics that efficiently convert the raw power and low level signal to drive the loudspeaker directly. The power comes from a typical desktop power supply, from which the power is combined with the sound masking and audio signals using a power injector unit that distributes the combined power and signals to loudspeakers. The loudspeakers can connect to an individually addressed sound masking network.

26 Claims, 13 Drawing Sheets

(51) Int. Cl.

| | |
|---|---|
| ***H04R 1/40*** | (2006.01) |
| ***H04R 3/12*** | (2006.01) |
| ***H04R 9/06*** | (2006.01) |

(56) References Cited

U.S. PATENT DOCUMENTS

| | | | | |
|---|---|---|---|---|
| 4,674,124 | A | 6/1987 | Horrall et al. | |
| 4,686,693 | A | 8/1987 | Ritter | |
| 4,914,706 | A | 4/1990 | Krause | |
| 6,164,408 | A | 12/2000 | Lamm et al. | |
| 6,188,771 | B1 | 2/2001 | Horrall | |
| 6,888,945 | B2 | 5/2005 | Horrall | |
| 6,950,526 | B2 | 9/2005 | Garstick | |
| 7,181,021 | B2 | 2/2007 | Raptopoulos et al. | |
| 7,194,094 | B2 | 3/2007 | Horrall et al. | |
| 7,460,675 | B2 | 12/2008 | L'Esperance et al. | |
| 7,471,797 | B2 | 12/2008 | Moeller et al. | |
| 7,548,854 | B2 | 6/2009 | Roy et al. | |
| 8,107,639 | B2 | 1/2012 | Moeller et al. | |
| 8,189,802 | B2 | 5/2012 | Miao et al. | |
| 8,428,272 | B2 | 4/2013 | Tohyama et al. | |
| 8,477,958 | B2 | 7/2013 | Moeller et al. | |
| 8,761,411 | B2 | 7/2014 | Zickmantel | |
| 8,817,999 | B2 | 8/2014 | Moeller et al. | |
| 8,972,251 | B2 | 3/2015 | Xiang et al. | |
| 9,076,430 | B2 | 7/2015 | Horrall et al. | |
| 9,088,856 | B2 | 7/2015 | Moeller et al. | |
| 9,117,436 | B2 | 8/2015 | Kobayashi et al. | |
| 2003/0107478 | A1 | 6/2003 | Hendricks et al. | |
| 2003/0219133 | A1* | 11/2003 | Horrall | G10K 11/175 381/73.1 |
| 2004/0146168 | A1 | 7/2004 | Goubran et al. | |
| 2006/0247919 | A1 | 11/2006 | Specht et al. | |
| 2008/0002836 | A1 | 1/2008 | Moeller et al. | |
| 2009/0074199 | A1 | 3/2009 | Kierstein et al. | |
| 2009/0116659 | A1* | 5/2009 | Moeller | H04S 3/02 381/73.1 |
| 2010/0027806 | A1 | 2/2010 | Heine et al. | |
| 2011/0026724 | A1 | 2/2011 | Doclo | |
| 2011/0188666 | A1 | 8/2011 | Mason et al. | |
| 2013/0016847 | A1 | 1/2013 | Steiner | |
| 2013/0046546 | A1* | 2/2013 | Uhle | G10L 21/00 704/500 |
| 2013/0089213 | A1 | 4/2013 | Heine et al. | |
| 2013/0163772 | A1 | 6/2013 | Kobayashi et al. | |
| 2013/0163778 | A1 | 6/2013 | Ito et al. | |
| 2013/0170655 | A1 | 7/2013 | Satoyoshi et al. | |
| 2013/0259254 | A1 | 10/2013 | Xiang et al. | |
| 2013/0315413 | A1 | 11/2013 | Yamakawa et al. | |
| 2014/0086426 | A1 | 3/2014 | Yamakawa et al. | |
| 2014/0114623 | A1 | 4/2014 | Moeller et al. | |
| 2014/0334634 | A1 | 11/2014 | Lewis | |
| 2015/0194144 | A1 | 7/2015 | Park et al. | |
| 2015/0256930 | A1 | 9/2015 | Yamakawa | |
| 2015/0287421 | A1 | 10/2015 | Benway et al. | |
| 2016/0112784 | A1 | 4/2016 | Heine et al. | |
| 2016/0157001 | A1* | 6/2016 | Manouel | H04R 1/025 381/332 |
| 2017/0214990 | A1* | 7/2017 | Calisi | H04R 1/028 |

FOREIGN PATENT DOCUMENTS

| | | |
|---|---|---|
| JP | 4734627 | 7/2011 |
| JP | 4816417 | 11/2011 |
| JP | 5103973 | 12/2012 |
| WO | WO 2006/056856 | 6/2006 |
| WO | WO 2006/127656 A2 | 11/2006 |
| WO | WO 2009/156928 | 12/2009 |
| WO | WO 2014/207256 | 12/2014 |

OTHER PUBLICATIONS

Tamesue et al. "Sound masking for achieving speech privacy with parametric acoustic array speaker." Soft Computing and Intelligent Systems (SCIS), 2014 Joint 7th International Conference on and Advanced Intelligent Systems (ISIS), 15th International Symposium on. IEEE, pp. 1134-1137 (2014).

Hongisto et al. "Effect of sound masking on workers in an open office." Proceedings of Acoustics. vol. 8. No. 29, pp. 537-542 (2008).

Notification of Transmittal of the International Search Report and the Written Opinion of the International Searching Authority, or the Declaration, International Search Report and Written Opinion for Int'l Application No. PCT/US2017/033303, entitle: "Self-Powered Loudspeaker for Sound Masking", dated Aug. 10, 2017.

* cited by examiner

SELF-POWERED LOUDSPEAKER FOR SOUND MASKING

RELATED APPLICATION

This application claims the benefit of U.S. Provisional Application No. 62/339,417, filed on May 20, 2016, the entire teachings of which application are incorporated herein by reference.

BACKGROUND

Previous direct field sound masking systems have used a single, often quite small, controller to drive hundreds of loudspeaker emitters, which can cover thousands of square feet with sound masking. Such systems can, for example, be of the type taught in U.S. Pat. No. 7,194,094 B2 of Horrall et al., the teachings of which patent are incorporated by reference in their entirety. The foregoing qualities of such systems are possible because of the very low power needed for direct field sound masking as compared with the power and costs of in-plenum systems. Such direct field sound masking systems can use readily available cabling and a simple installation process.

Unfortunately, there are some situations in which such existing direct field systems have drawbacks for achieving real paging capability, without using a duplicate sound system. Also, because low frequency response is sacrificed for economy, size, and power, it is sometimes not possible to extend the sound masking spectrum to low frequencies, such as below about 250 Hz.

Louder paging and lower frequencies require more power at each emitter, which is not consistent with the architecture of existing direct field systems. Desired ideal paging levels would require about 100 times the level achieved by existing systems, or 100 times the power. This would require an entirely different system than existing direct field systems. The power required in a central controller for these power levels would be hundreds of watts and simply would not be an efficient or cost effective solution.

SUMMARY

In accordance with an embodiment of the invention, there is provided a sound masking system that includes a self-amplified loudspeaker emitter unit, with a driver and enlarged ported enclosure, sufficient to provide a frequency range down to a low frequency, such as about 125 Hz. To deliver the power, the power distribution architecture includes audio power amplifiers in the emitter housing of each loudspeaker. Raw power is delivered to each emitter unit through a cable and connectors, such as an Ethernet cable and connectors, in the same cable with the sound masking and audio signals. Inside the emitter units are electronics that efficiently convert the raw power and low level signal to drive the loudspeaker directly. The power comes from a typical desktop power supply, from which the power is combined with the sound masking and audio signals using a power injector unit that distributes the combined power and signals to the loudspeakers.

In one embodiment of the invention, there is provided a direct field sound masking system for providing a direct path sound masking signal to the ears of a listener in a predetermined area of a building, said predetermined area including a ceiling and a floor. The system comprises a plurality of loudspeaker assemblies, each loudspeaker assembly coupled to one or more sources of an electrical sound signal. Each of the plurality of loudspeaker assemblies has a voice coil coupled to an audio emitter operative to emit an acoustic sound signal corresponding to said electrical sound signal, wherein each said audio emitter is a cone emitter, wherein each of the plurality of loudspeaker assemblies has a low directivity index, and wherein each of the plurality of loudspeaker assemblies is constructed and oriented to provide the acoustic sound signal in a direct path to the ears of said listener in said predetermined area. There is an audio power amplifier within a loudspeaker enclosure of each loudspeaker assembly of the plurality of loudspeaker assemblies.

In further, related embodiments, the electrical sound signal can comprise at least one of a sound masking signal, a music signal and a paging signal. The plurality of loudspeaker assemblies can be interconnected via a plurality of multi-conductor wiring cables, each multi-conductor wiring cable of the plurality of multi-conductor wiring cables comprising at least one raw power conductor and at least one electrical sound signal conductor. Each multi-conductor wiring cable of the plurality of multi-conductor wiring cables can be terminated at both ends with quick connect/disconnect connectors, said quick connect/disconnect connectors corresponding to integral input and output jacks on said loudspeaker assemblies. The quick connect/disconnect connectors can, for example, be TIA/EIA-IS-968-A Registered Jack 45 (RJ-45) connectors. The multi-conductor wiring cables can comprise at least four pairs of conductors; for example, the multi-conductor wiring cables can comprise four electrical sound signal conductors, two raw power conductors and two common ground conductors. In the plurality of loudspeaker assemblies each having a low directivity index, each said audio emitter can have an effective aperture area that is less than or equal to the area of a circle having a diameter of 3.0 inches, such as less than or equal to the area of a circle having a diameter of 1.5 inches, and in particular having, for example, an effective aperture area that is equal to the area of a circle having a diameter of between 1.25 inches and 3 inches.

In other, related embodiments, at least one loudspeaker assembly of the plurality of loudspeaker assemblies can be electrically coupled to a power injector via at least one multi-conductor wiring cable of the plurality of multi-conductor wiring cables. The power injector is electrically connected to (i) a control module comprising the one or more sources of the electrical sound signal, and (ii) a power supply. The power injector transfers power from the power supply onto the at least one raw power conductor of the at least one multi-conductor wiring cable; and the power injector transfers the electrical sound signal from the one or more sources of the electrical sound signal onto the at least one electrical sound signal conductor of the at least one multi-conductor wiring cable. The loudspeaker enclosure of each loudspeaker assembly of the plurality of loudspeaker assemblies can comprise a port opening from an exterior of an aperture of the loudspeaker assembly to an interior of the loudspeaker enclosure. The port opening can, for example, comprise a diameter of between about 0.3 inches and about 0.5 inches and a length of between about 1.5 inches and about 2.5 inches. The loudspeaker enclosure of each loudspeaker assembly of the plurality of loudspeaker assemblies can, for example, comprise an enclosure length of at least about 3.5 inches from an aperture face of the loudspeaker to the rear of the loudspeaker, such as at least about 4.0 inches from an aperture face of the loudspeaker to the rear of the loudspeaker.

In further related embodiments, the acoustic sound signal can comprise an acoustic sound masking signal comprising a corresponding sound masking spectrum, said sound masking spectrum having a low end frequency of at least about 80 Hz and a high end frequency of less than about 5300 Hz. The sound masking spectrum can comprise a frequency response of at least about 40 dB in the 125 Hz one-third octave band of the sound masking spectrum, such as at least about 45 dB in the 125 Hz one-third octave band of the sound masking spectrum. Further, the sound masking spectrum can comprise a frequency response that falls below about 20 dB in the range of between about 4000 Hz and about 5000 Hz of the sound masking spectrum. The acoustic sound signal can comprise a paging or music loudness of at least about 80 dBA in the covered area. The system can further comprise a voltage regulator powering the audio power amplifier within the loudspeaker enclosure of each loudspeaker assembly of the plurality of loudspeaker assemblies.

In other related embodiments, each of the plurality of loudspeaker assemblies can be constructed and oriented to provide the acoustic sound signal to at least one sound masking zone in the predetermined area of the building. The system can further comprise a plurality of passive loudspeaker assemblies, each passive loudspeaker assembly coupled to the one or more sources of an electrical sound signal; wherein each of the plurality of passive loudspeaker assemblies lacks an audio power amplifier within a loudspeaker enclosure of each passive loudspeaker assembly of the plurality of passive loudspeaker assemblies.

In further related embodiments, at least one loudspeaker assembly of the plurality of loudspeaker assemblies can further comprise an individually addressed network connector, the individually addressed network connector receiving audio signals individually addressed to the at least one loudspeaker assembly from an individually addressed sound masking network. The individually addressed sound masking network can comprise multi-conductor wiring cables that conduct both power and the individually addressed audio signals. The multi-conductor wiring cables comprised in the individually addressed sound masking network can comprise Power over Ethernet cables. The individually addressed sound masking network can comprise at least one of: an individually addressed network processor, an individually addressed network loudspeaker controller and a network switch. The individually addressed network processor can comprise a processor configured to emit electronic signals comprising at least one of: sound masking signals, paging signals and music signals. The at least one loudspeaker assembly can further comprise an internal loudspeaker connection directly from the individually addressed network loudspeaker controller to the voice coil of the at least one loudspeaker assembly. The at least one loudspeaker assembly can either (a) receive audio signals individually addressed to the at least one loudspeaker assembly from the individually addressed sound masking network, through the individually addressed network connector, or (b) be electrically coupled to a power injector via at least one multi-conductor wiring cable, the power injector being electrically connected to (i) a control module comprising the one or more sources of the electrical sound signal, and (ii) a power supply.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

FIG. 8A is a schematic diagram of conductors in a multi-conductor cable used in previous direct field sound masking systems, whereas

DETAILED DESCRIPTION

A description of example embodiments follows.

Figure 1:
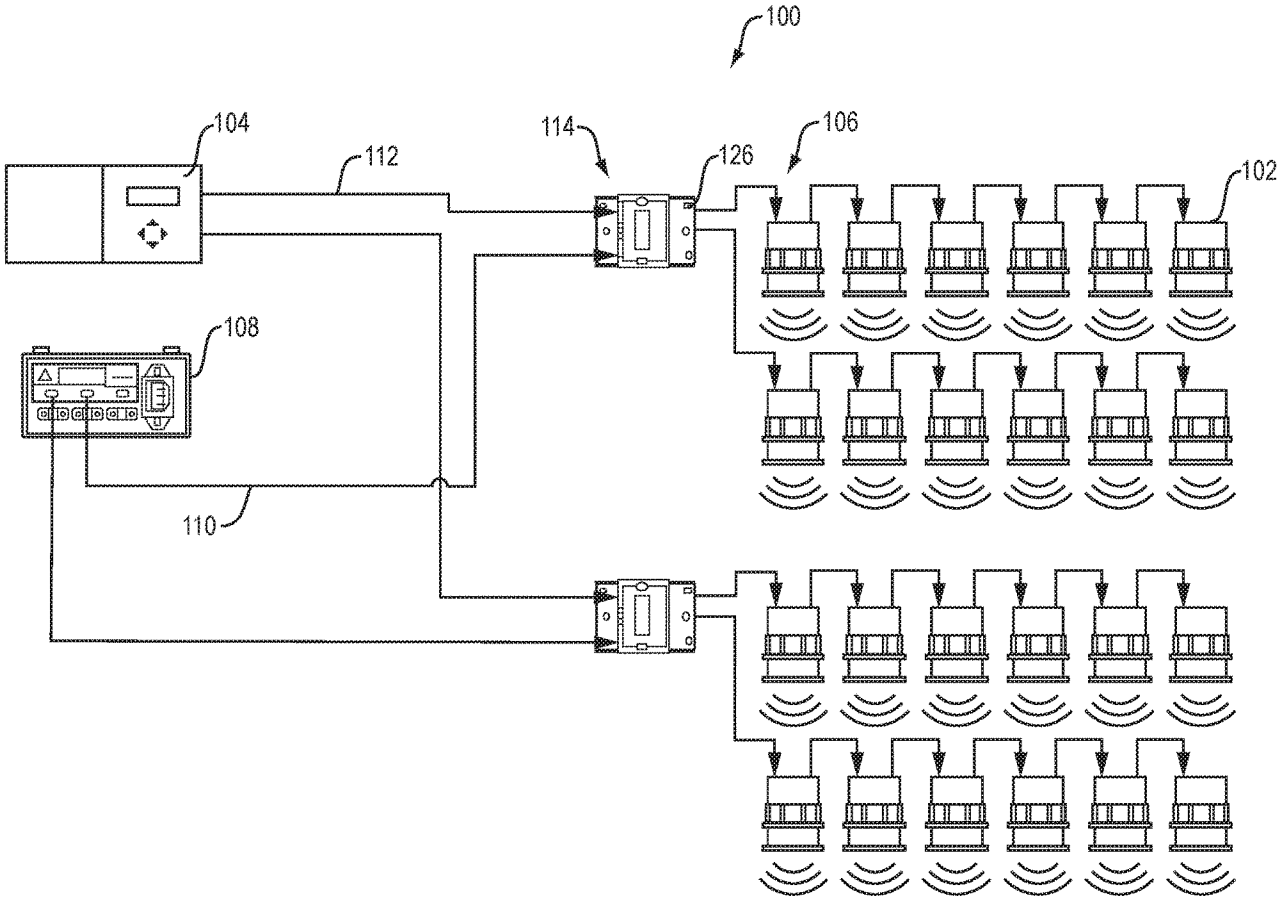
FIG. 1 is a schematic diagram of a sound masking system using self-powered loudspeakers, in accordance with an embodiment of the invention.

FIG. 1 is a schematic diagram of a sound masking system 100 using self-powered loudspeakers 102, in accordance with an embodiment of the invention. The sound masking system 100 is used to produce a sound masking zone in a predetermined area of a building, below the loudspeakers 102. The loudspeakers 102 are coupled via electrical connections to one or more sources 104 of an electrical sound signal, which includes a sound masking signal, and which may also include a music signal and/or a paging signal. The loudspeakers 102 emit an acoustic sound signal in response to the electrical sound signal, and, when the sound masking function of the sound masking system is activated, emit an acoustic sound masking signal. The loudspeakers 102 are constructed and oriented to provide the acoustic sound signal to the sound masking zone. For example, the loudspeakers 102 may be positioned facing downwards from a suspended ceiling, so as to transmit the sound masking signal directly to the ears of a listener in the sound masking zone.

In accordance with the embodiment of FIG. 1, the sound masking system 100 includes self-amplified loudspeaker emitter units 102, each with a driver and enlarged ported enclosure, sufficient to provide a frequency range down to a low frequency, such as about 125 Hz. To deliver the power, the power distribution architecture includes audio power amplifiers in the emitter housing of each loudspeaker 102. Raw power is delivered to each emitter unit through a cable 106 and connectors, such as an Ethernet cable and connectors, in the same cable 106 with the sound masking and audio signals. Inside the emitter units 102 are electronics that efficiently convert the raw power and low level signal to drive the loudspeaker directly. The power comes from a typical desktop power supply 108, from which the power in power cable 110 is combined with the sound masking and audio signals in signal cables 112 using a power injector unit 114, which distributes the combined power and signals through combined power/signal cables 106 to the loudspeakers 102.

The sounds played by the sound emitter units 102 can, for example, include dedicated sound masking signals (which use a sound masking spectrum), in order to mask outside, human speech in a context such as an open plan office, or any of a variety of other contexts in which sound masking can be used. The system can also emit a paging address including live or recorded human speech, and can emit music.

Figure 2:
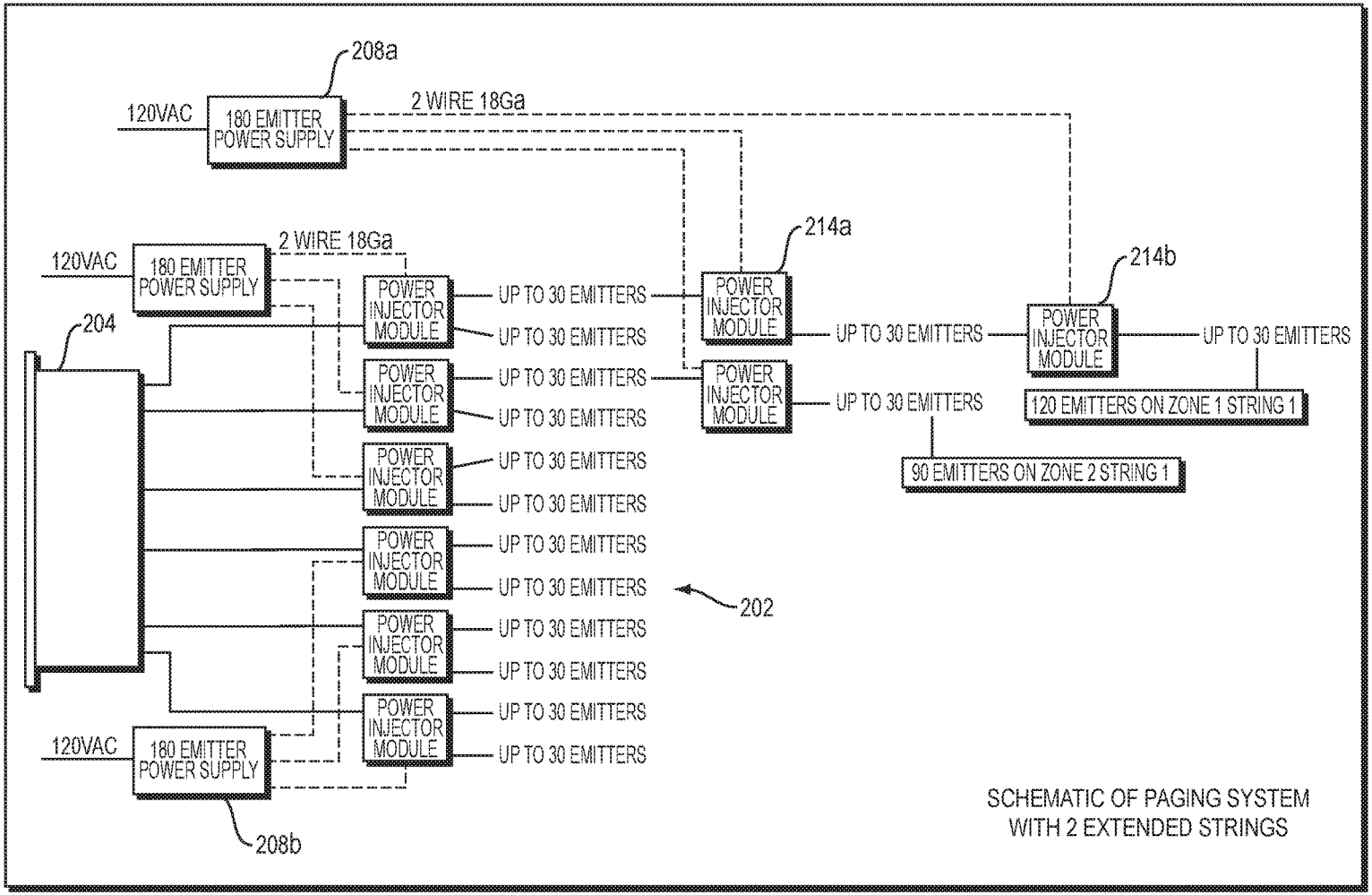
FIG. 2 is a schematic diagram of a sound masking system using multiple strings of self-powered loudspeakers, in accordance with an embodiment of the invention.
Figure 4:
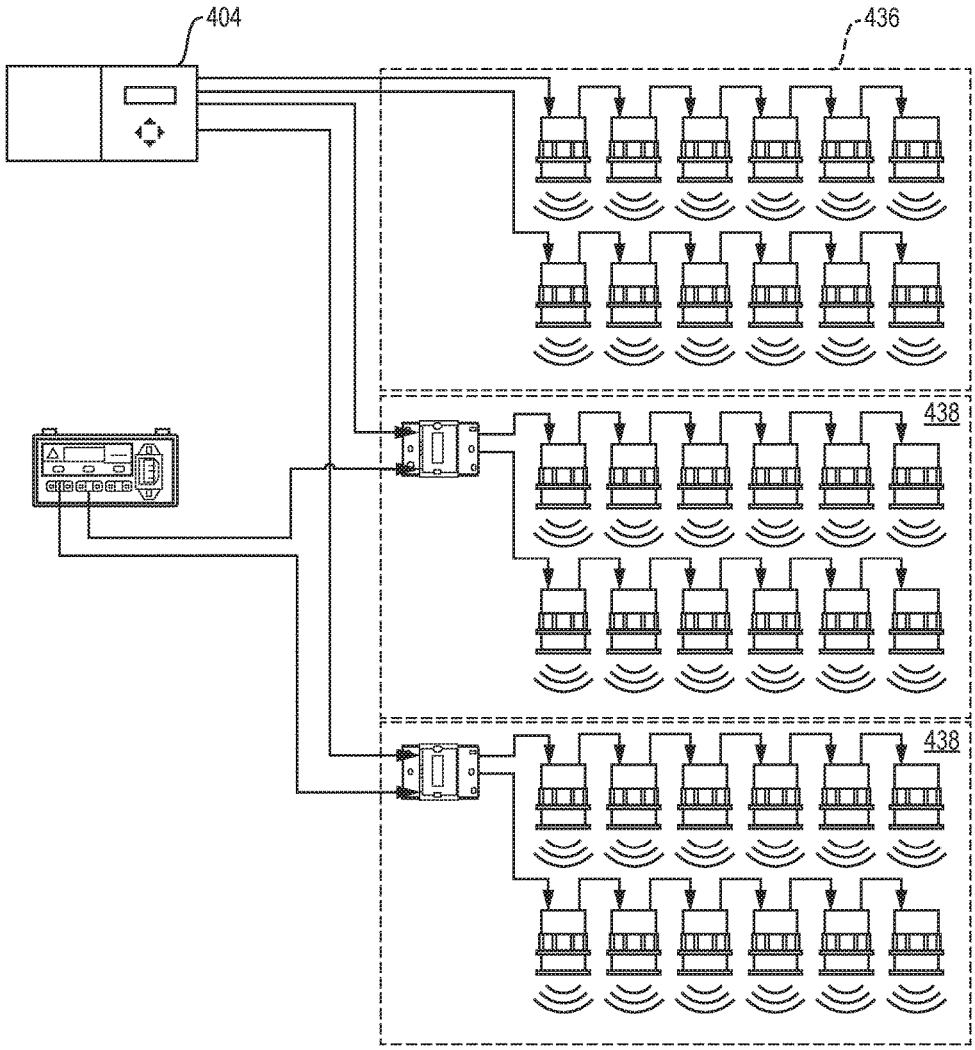
FIG. 4 is a schematic diagram of a sound masking system using multiple zones, with some zones include passive loudspeaker assemblies and others using self-powered loudspeakers, in accordance with an embodiment of the invention.

FIG. 2 is a schematic diagram of a sound masking system using multiple strings of self-powered loudspeakers 202, in accordance with an embodiment of the invention. By using additional power supplies 208*a*, 208*b*, and multiple power injector units 214*a*, 214*b*, it can be seen that multiple strings of self-powered loudspeakers 202 can be used. In one embodiment, one power supply 208*a*/208*b* is used to power up to 180 emitters 202 total. In practice, the number of emitters 202 possible on one string may, for example, be practically limited to 30 emitters, depending on the limits of the Ethernet cable and connectors. However, by adding additional power supplies 208*a*/208*b* and power injectors 214*a*/214*b*, the string of loudspeakers 202 can, in principle, be continued indefinitely. To install the system, the power injector 214*a*/214*b* is plugged directly into a zone output of the controller 204, and the power from the supply 208*a*/208*b* is connected via a 2-wire cable to the power injector 214*a*/214*b*. A power injector 214*a*/214*b* can, for example, be added to any string after 30 emitters and so on indefinitely. It will be appreciated that other configurations are possible. Other zones on the controller can still be used as passive emitter sound masking zones, as shown in FIG. 4, below. Paging zones can be retrofitted to existing installations by adding the power injectors 214*a*/214*b* and the self-powered emitters 202.

Figure 3A:
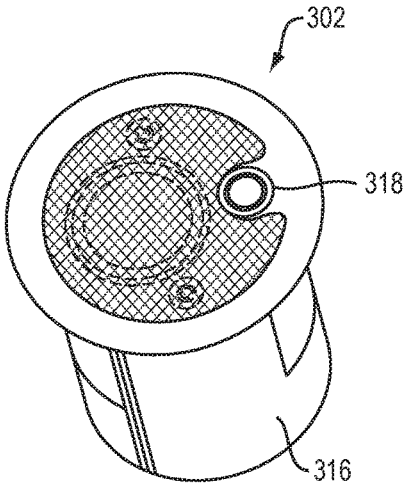
FIG. 3A is a front perspective view.
Figure 3B:
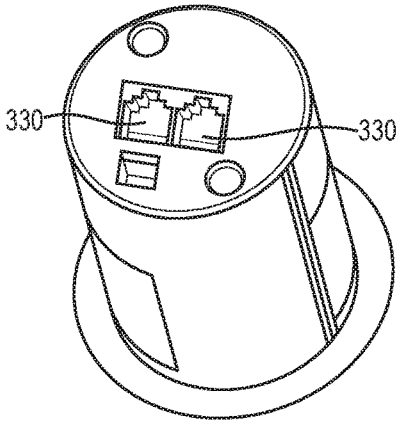
FIG. 3B is a rear perspective view.
Figure 3C:
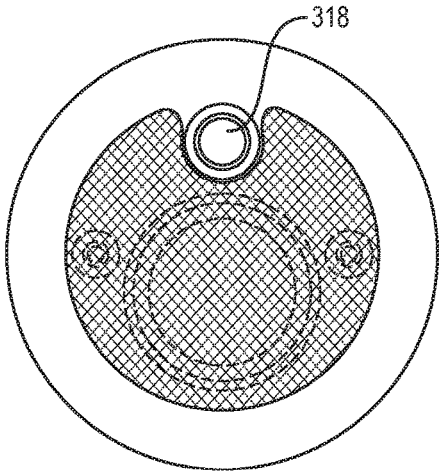
FIG. 3C is a front view, of an enclosure of a self-powered loudspeaker, in accordance with an embodiment of the invention.

FIG. 3A is a front perspective view, FIG. 3B is a rear perspective view, and FIG. 3C is a front view, of an enclosure of a self-powered loudspeaker 302, in accordance with an embodiment of the invention. The emitter 302 uses an enclosure 316 with a port 318 on the face. It can have, for example, a long throw, low distortion, 1½" diameter driver. The assembly of the loudspeaker 302 has active electronics inside the enclosure 316, instead of a transformer, as is used in a passive loudspeaker unit. Connections to each emitter unit 302 can be made with quick connect/disconnect connectors, such as an RJ45 connector, and Ethernet cable. The power voltage carried by the Ethernet cable into the enclosure 316 can, for example, be 36V DC, and the audio signal can come from an existing controller 104 (see FIG. 1) that can also be used with passive loudspeakers for direct field sound masking. The power voltage can, for example, be 36 V DC, but can also be higher or another value, such as 48 V DC. Inside the emitter 302 is an efficient voltage regulator (see 720 in FIG. 7, below) to reduce the incoming voltage to 5 volts. This voltage powers a Class D audio power amplifier (see 722 in FIG. 7, below) to drive the speaker 302 directly.

In accordance with an embodiment of the invention, the loudspeaker assembly 302 is designed to minimize the work and effort required to provide a correct installation of the sound masking speakers and associated wiring. Each loudspeaker assembly 302 can be connected using readily available and inexpensive wiring with at least four pairs of conductors, such as CAT-3, 5, 5A or 6 wire. In one embodiment, the plurality of loudspeaker assemblies 302 are interconnected via multi-conductor American Wire Gage (AWG) No. 24 size wiring pieces. To simplify assembly, the wiring pieces are terminated at both ends with quick connect/disconnect connectors, such as RJ-45 or RJ-11 connectors, corresponding to integral input and output jacks 330 on the loudspeakers. This eliminates any need for on-the-job cable stripping. In particular, the quick connect/disconnect connectors can be TIA/EIA-IS-968-A Registered Jack 45 (RJ-45) connectors. The multi-conductor wiring pieces can comprise at least four pairs of conductors, as discussed further below in connection with FIGS. 8A and 8B.

In the embodiment of FIGS. 3A-3C, the port 318 opening can comprise a diameter of between about 0.3 inches and about 0.5 inches and a length of between about 1.5 inches and about 2.5 inches. The loudspeaker enclosure 316 can comprise an enclosure length of at least about 3.5 inches from an aperture face of the loudspeaker to the rear of the loudspeaker, such as at least about 4.0 inches from an aperture face of the loudspeaker to the rear of the loudspeaker, such as between about 3.5 inches and 4.5 inches.

An embodiment according to the invention can provide a sound masking system in which the paging or music loudness will be increased to at least 80 dBA in the covered area, which is at least about 14 dBA higher than previous designs. The design can expand the frequency response at the low frequency end of the spectrum, for example to the 125 Hz ⅓ octave band—a lower frequency than previous similar systems.

Returning to the embodiment of FIG. 1, the power injector 114 adapter box connects the powered emitters 102 to the controller 104 and to the power supply 108. The power injector 114 box can, for example, have quick connect/disconnect connectors, such as RJ45 connectors, which take in the audio signals over signal cables 112 from a controller zone and send them to two output connectors 126. The signal cables 112 can, for example, be CAT 3 UTP cables, although it will be appreciated that other types of cable can be used. The power injector 114 also takes in power, over power cable 110, from the desktop power supply 108, and distributes this power to its two output connectors 126, which connect the combined power/audio signal to cables 106. The power cable 110 can, for example, be 14/2 AWG cable, and the combined power/audio signal cables 106 can, for example, use CAT 3 UTP cable, although it will be appreciated that other types of cable can be used. The controller 104 and power supply 108 can be housed in a small enclosure that can be mounted where convenient.

In accordance with an embodiment of the invention, one or more sources of the electrical sound signal can be characterized as a portion of a controller 104. It will be appreciated that the controller 104 can include a microprocessor or other suitable circuitry to implement the control, automation, communication and other computing functions necessary to configure embodiments taught herein.

In accordance with an embodiment of the invention, the low-frequency response of the sound masking speaker system 100 is improved, thereby improving the acoustic qualities of emitted human speech, for example for paging. Low frequency performance (for example, to the 125 Hz ⅓ octave band) is provided, and the desired sound level for paging and music is provided, while the system adds only a low cost and integrates easily with existing components.

FIG. 4 is a schematic diagram of a sound masking system using multiple zones, with some zones 436 include passive loudspeaker assemblies and others 438 using self-powered loudspeakers, in accordance with an embodiment of the invention. The loudspeaker assemblies in zones 436 are conventional direct field sound masking loudspeakers, which do not include active electronics within their loudspeaker enclosures to provide power amplification, as in the self-powered loudspeakers in accordance with an embodiment of the invention. The loudspeakers in zones 436 can, for example, include conventional transformers. In accordance with an embodiment of the invention, the controller 404 can output two different types of signals, one type to control the passive sound masking loudspeakers, and one type to control the self-powered sound masking loudspeakers. For example, the signals for the self-powered loudspeakers can have a lower frequency spectrum than those for the passive loudspeakers, owing to the loudspeaker design taught herein; and the signal voltage can be lower, because the self-powered loudspeakers perform their own amplification. The settings used by the controller 404 (whether for self-powered loudspeakers or passive loudspeakers) can be toggled on a zone-by-zone basis, in accordance with an embodiment of the invention.

Figure 5:
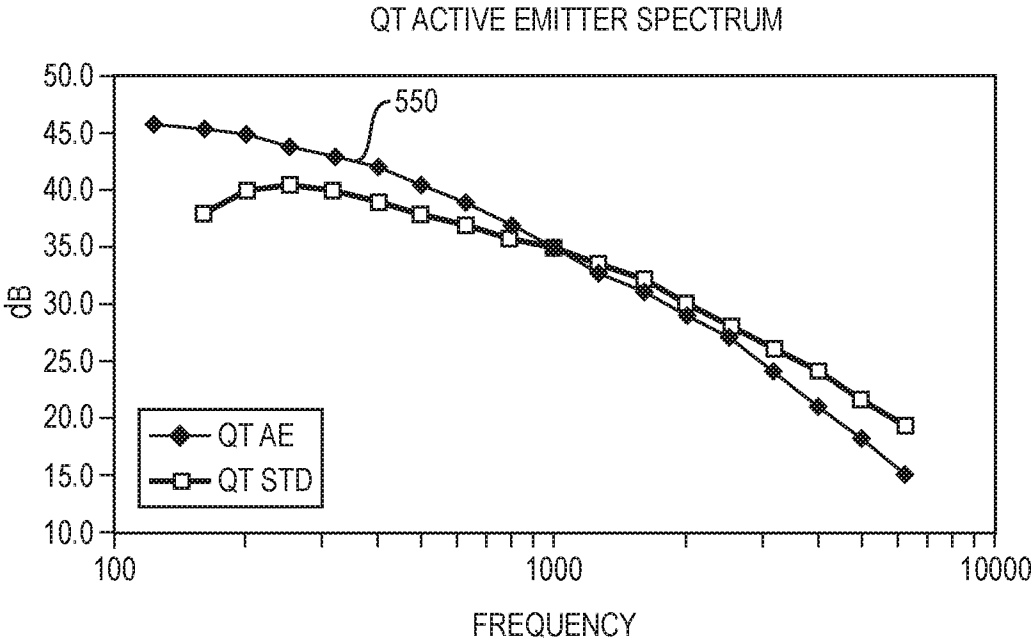
FIG. 5 is a diagram showing a sound masking spectrum that can be used with self-powered loudspeakers in accordance with an embodiment of the invention.

FIG. 5 is a diagram showing a sound masking spectrum 550 that can be used with self-powered loudspeakers in accordance with an embodiment of the invention. Another standard curve is shown for comparison. For an acoustic sound masking signal, a sound masking system in accordance with an embodiment of the invention may use a sound masking spectrum based on the principles of the spectrum described in L. L. Beranek, "Sound and Vibration Control," McGraw-Hill, 1971, Page 593, the teachings of which reference are incorporated by reference in their entirety. The low end frequencies of the selected spectrum can comprise at least one of 50 Hz, 80 Hz, 100 Hz and 125 Hz. The high end frequencies can be less than 8 kHz, 7 kHz, 6 KHz, or about 5300 Hz or less. It will be appreciated that other sound masking spectra may be used. In particular, using a self-powered loudspeaker in accordance with an embodiment of the invention, the sound masking spectrum 550 can comprises a frequency response of at least about 40 dB in the 125 Hz one-third octave band of the sound masking spectrum, such as at least about 45 dB in the 125 Hz one-third octave band of the sound masking spectrum. In addition, the sound masking spectrum 550 can comprise a frequency response that falls below about 20 dB in the range of between about 4000 Hz and about 5000 Hz of the sound masking spectrum.

Figure 6:
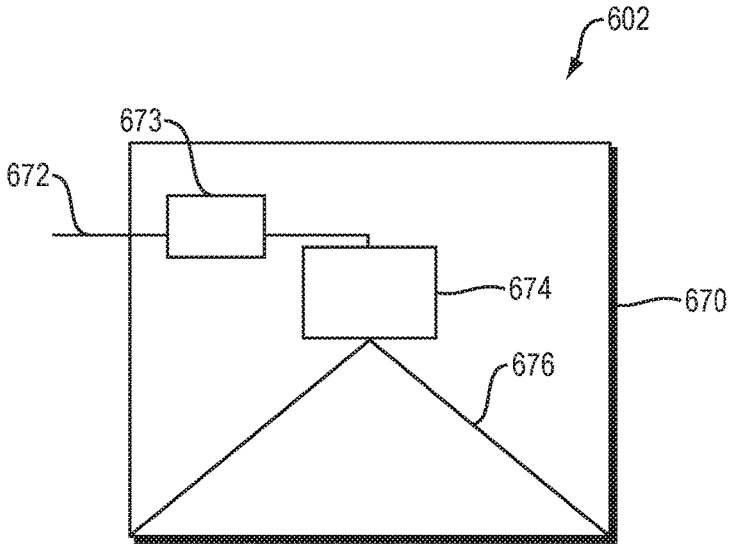
FIG. 6 is a schematic diagram of a loudspeaker assembly in a sound masking system in accordance with an embodiment of the invention.

FIG. 6 is a schematic diagram of a loudspeaker assembly 602 in a sound masking system in accordance with an embodiment of the invention. The loudspeaker assembly 602 includes a substantially airtight case 670, an input connection 672, an input network 673 and a voice coil 674 that is coupled to audio emitter 676, which can be a cone emitter. The audio emitter 676 is operative to emit the acoustic sound masking signal. The cone loudspeaker assembly 602 may comprise a low directivity index loudspeaker. In one embodiment, all of the loudspeaker assemblies in the sound masking system may be low directivity index loudspeakers. Returning to FIG. 6, a loudspeaker assembly 602 can have a cone emitter 676 having an effective aperture area that is less than or equal to the area of a circle having a diameter of 3.0 inches; or that is less than or equal to the area of a circle having a diameter of 1.5 inches; or that is equal to the area of a circle having a diameter of between 1.25 inches and 3 inches; and may be of a type that is suitable to function as a direct field, low directivity index cone loudspeaker, such as the type taught in U.S. Pat. No. 7,194,094 B2 of Horrall et al., the teachings of which patent are incorporated by reference in their entirety. As used herein, a "direct field sound masking system" is one in which the acoustic sound masking signal or signals, propagating in a direct audio path from one or more emitters, dominate over reflected and/or diffracted acoustic sound masking signals in the sound masking zone. A "direct audio path" is a path in which the acoustic masking signals are not reflected or diffracted by objects or surfaces and are not transmitted through acoustically absorbent surfaces within a masking area or zone.

Figure 7:
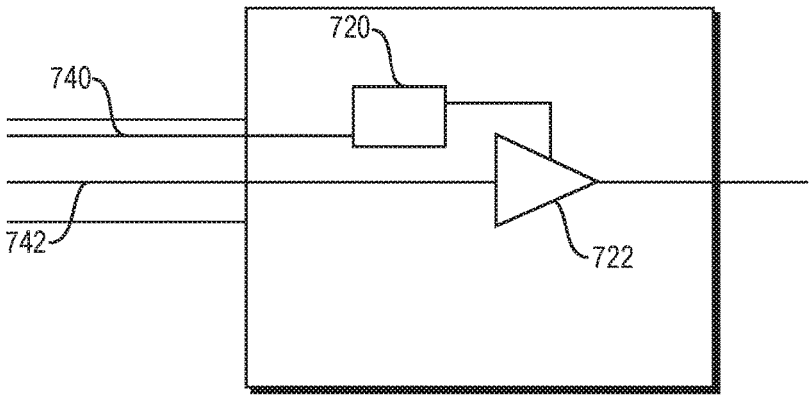
FIG. 7 is a schematic diagram of electrical components within a self-powered loudspeaker in accordance with an embodiment of the invention.

FIG. 7 is a schematic diagram of electrical components of an input network 673 (see FIG. 6) within a self-powered loudspeaker in accordance with an embodiment of the invention. A voltage regulator 720 reduces the incoming voltage from the power portion 740 of input cable 672 to 5 volts. This voltage powers an audio power amplifier 722, such as a Class D audio power amplifier, to drive the speaker 674 (see FIG. 6) using the signals received over the signal portion 742 of cable 672.

Figure 8A:
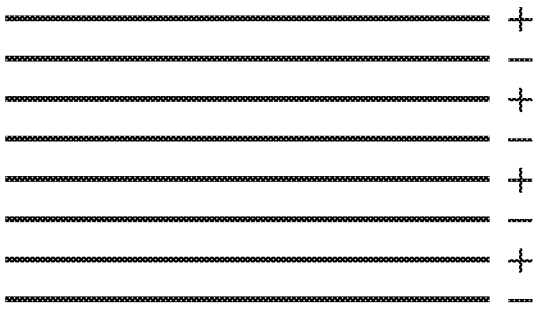
Figure 8B:
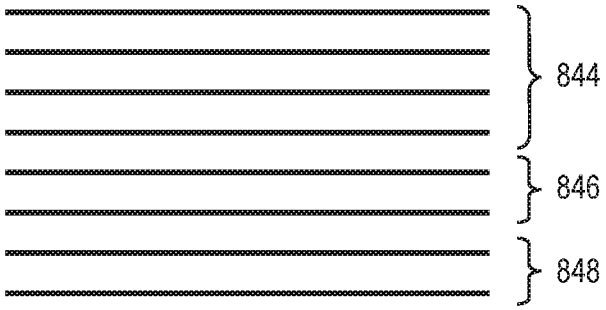
FIG. 8B is a schematic diagram of conductors in a multi-conductor cable that can be used with self-powered loudspeakers in accordance with an embodiment of the invention.

FIG. 8A is a schematic diagram of conductors in a multi-conductor cable used in previous direct field sound masking systems, whereas FIG. 8B is a schematic diagram of conductors in a multi-conductor cable that can be used with self-powered loudspeakers in accordance with an embodiment of the invention. In the multi-conductor cable of FIG. 8A, four pairs of sound signals are transmitted over the cable, as shown by the four pairs of "+" and "−" symbols. By contrast, in the multi-conductor cable of FIG. 8B, of the four pairs of conductors, there are four electrical sound signal conductors 844, two raw power conductors 846 and two common ground conductors 848. The multi-conductor cable of FIG. 8B can, for example, be used as cable 106 of FIG. 1, which carries both the power and the signal received from the power injector 114. Using two raw power conductors 846 halves the power loss over the cable. The power voltage can, for example, be 36 V, but can also be higher, such as 48 V, in order to minimize resistive losses.

Figure 9:
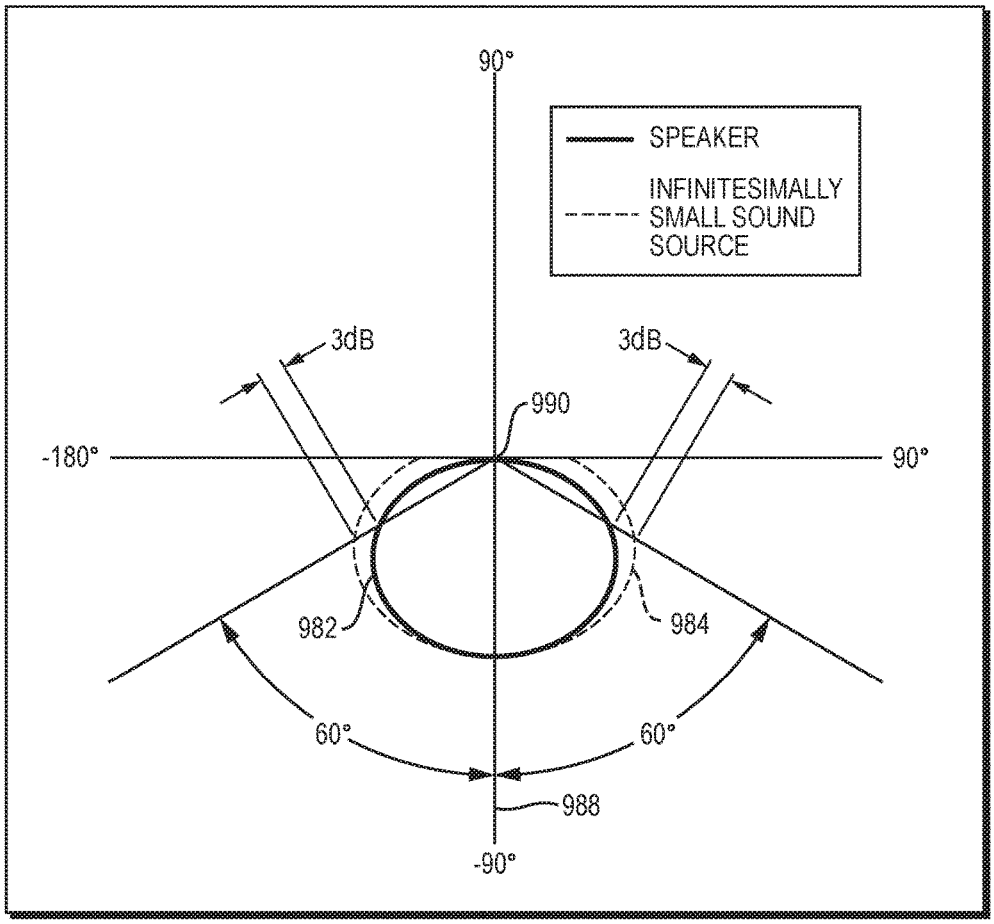
FIG. 9 is a schematic diagram illustrating a low directivity index loudspeaker that can be used in accordance with an embodiment of the invention.

FIG. 9 is a schematic diagram illustrating a low directivity index loudspeaker that can be used in accordance with an embodiment of the invention. A loudspeaker with a "low directivity index" is one that, with reference to the axial direction 988 of the speaker, at location 990 provides an output sound intensity 982 at an angle of 20 degrees, preferably 45 degrees, and most preferably 60 degrees from the axial direction, that is not more than 3 dB, and not less than 1 dB, lower than the output sound intensity 984 at the same angle from an infinitesimally small sound source at the same location in an infinite baffle at frequencies less than 6000 Hz, as measured in any one-third octave band. Accordingly, the low directivity index loudspeakers provide a substantially uniform acoustic output that extends nearly 180 degrees, i.e., plus or minus 90 degrees from the axial direction of the loudspeaker assembly.

Figure 10A:
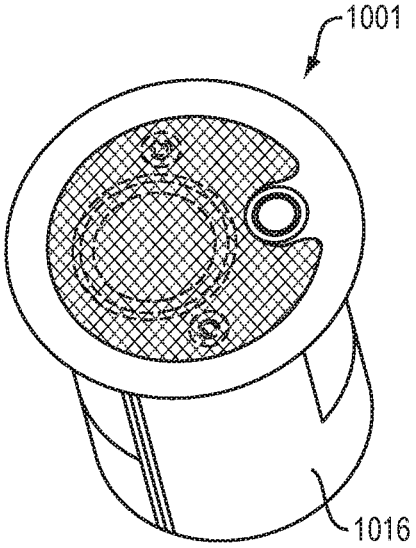
FIG. 10A is a front perspective view and FIG. 10B is a rear perspective view of an enclosure of a self-powered loudspeaker, in accordance with another embodiment of the invention, in which a individually addressed network connector is included on the enclosure of the loudspeaker assembly.
Figure 10B:
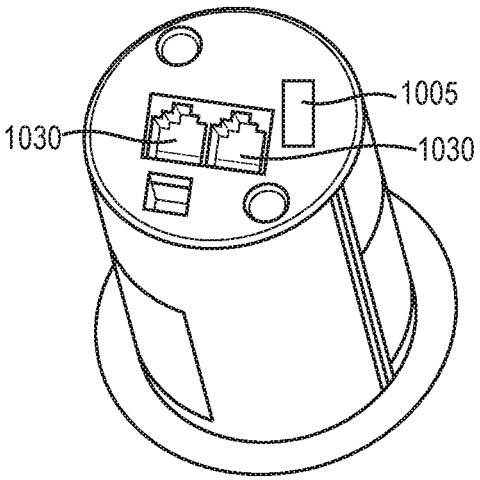

FIG. 10A is a front perspective view and FIG. 10B is a rear perspective view of an enclosure of a self-powered loudspeaker 1001, in accordance with another embodiment of the invention, in which a individually addressed network connector 1005 is included on the enclosure 1016 of the loudspeaker assembly. The individually addressed network connector 1005 receives audio signals individually addressed to the at least one loudspeaker assembly 1001 from an individually addressed sound masking network 1209 (see FIG. 12), as discussed further below. This individually addressed network connector 1005 can be present on the loudspeaker assembly 1001, in addition to connectors 1030, which function in the manner of connectors 330 (see FIGS. 3A-3C) to connect to a network 100 such as that of FIGS. 1 and 2 that includes power injectors and a power supply. In this way, a parallel, additional capacity is added to enable each loudspeaker assembly 1001 to be individually addressed by the individually addressed sound masking network 1209, as a parallel alternative to the network 100 of FIGS. 1 and 2. Thus, the loudspeaker assembly 1001 either (a) receives audio signals individually addressed to the loudspeaker assembly from the individually addressed sound masking network 1209 (see FIG. 12), through the individually addressed network connector 1005, or (b) is electrically coupled to a power injector 114 (see FIG. 1) via at least one multi-conductor wiring cable 106, for example via connectors 1030, where the power injector is electrically connected to (i) a control module 104 comprising one or more sources of an electrical sound signal, and (ii) a power supply 108. Connections to the individually addressed network connector 1005 (of FIG. 10) can, for example, be made with quick connect/disconnect connectors, such as an RJ45 connector, or, for example, a connector suitable to connect to speaker cable, such as 18-2 standard speaker cable.

Figure 11:
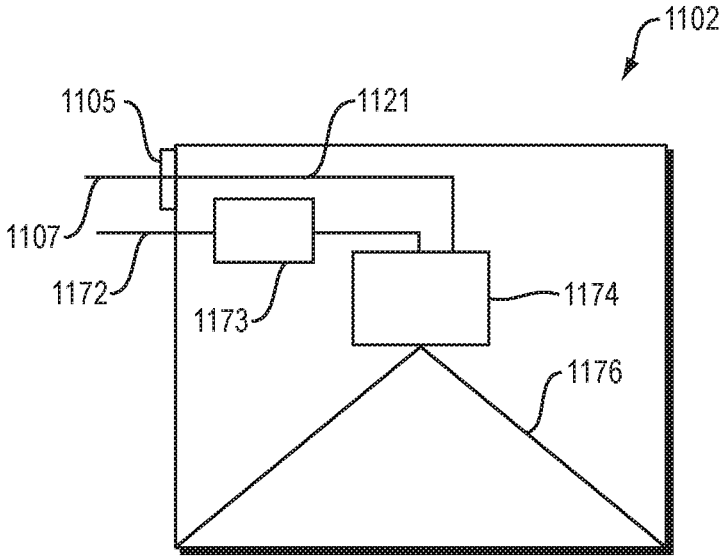
FIG. 11 is a schematic diagram of a loudspeaker assembly in a sound masking system in accordance with an embodiment of the invention, which includes an individually addressed network connector.

FIG. 11 is a schematic diagram of a loudspeaker assembly 1102 in a sound masking system in accordance with an embodiment of the invention, which includes an individually addressed network connector 1105. Here, it can be seen that the individually addressed network connector 1105 can be used to connect an audio signal line 1107 to an internal loudspeaker connection 1121, that connects directly from the individually addressed network connector 1105 to the voice coil 1174 of the loudspeaker assembly 1102. In this way, the voice coil 1174 can be used to drive the audio emitter 1176 via the individually addressed sound masking network, instead of via the signals from input connection 1172, which can come from a network such as network 100 of FIGS. 1 and 2. Thus, the internal loudspeaker connection 1121 permits the audio signals to bypass the input network 1173. The input network 1173 is, however, used in the fashion described in connection with FIGS. 6 and 7 for signals received over input connection 1172 from the network 100 of FIGS. 1 and 2. The loudspeaker assembly 1102 can include other components and features to those described above in connection with the embodiment of FIG. 6.

Figure 12:
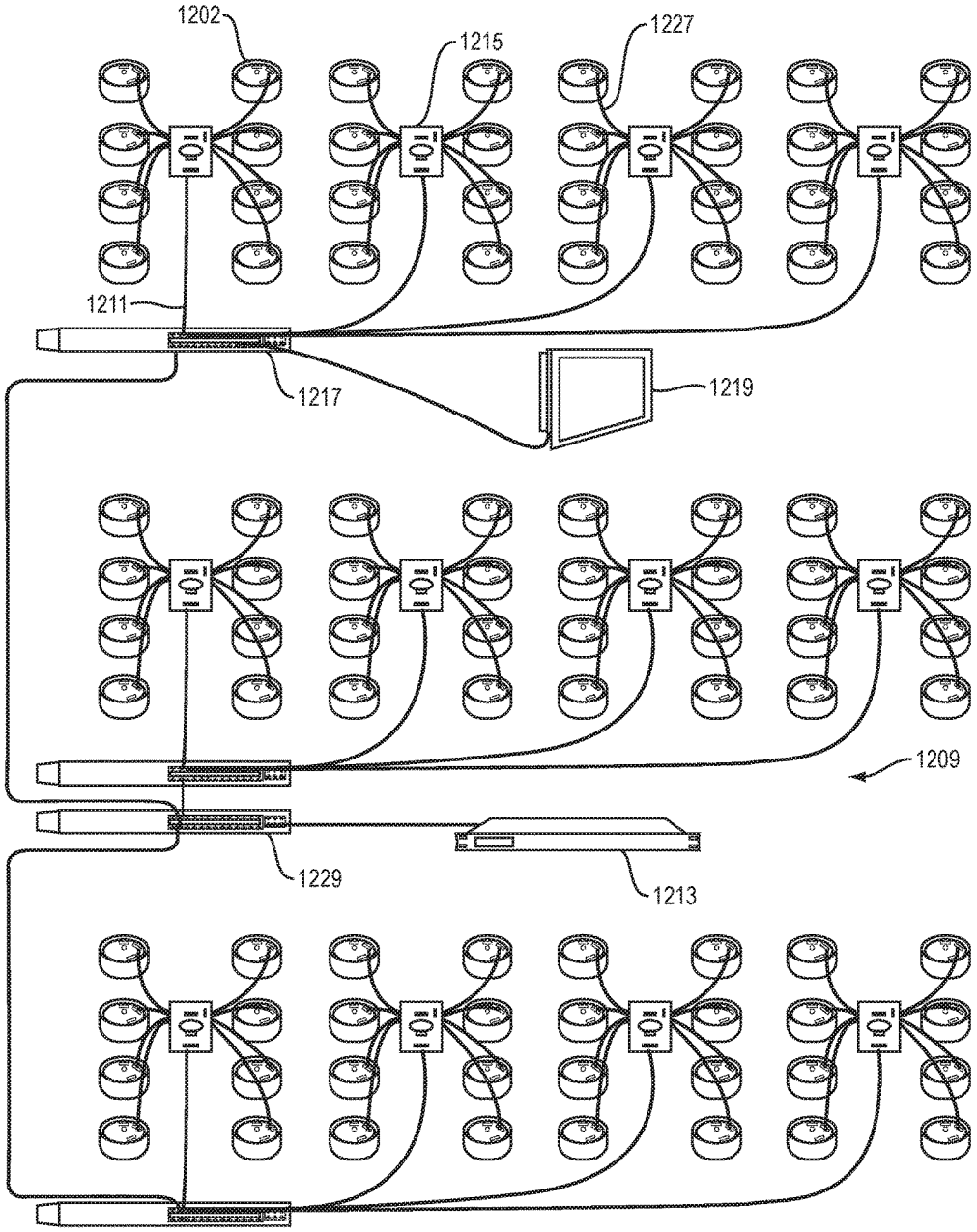
FIG. 12 is a schematic diagram of an individually addressed sound masking network that includes network addressable loudspeakers, in accordance with an embodiment of the invention.

FIG. 12 is a schematic diagram of an individually addressed sound masking network 1209 that includes network addressable loudspeakers, in accordance with an embodiment of the invention. As used herein, it will be appreciated that an "individually addressed sound masking network can include the capacity to perform not only sound masking, but also paging and music. The individually addressed sound masking network 1209 includes multi-conductor wiring cables 1211, such as Power over Ethernet cables, which conduct both power and the audio signals. For example, cables 1211 may use CAT 5 cable. An individually addressed network processor 1213 is used, which can be a processor configured to emit electronic signals comprising at least one of: sound masking signals, paging signals and music signals. The processor 1213 is used to input standard audio signals, such as paging or music, into the audio network 1209. Additionally, the processor 1213 is used to broadcast sound masking signals through its audio output channels. The processor 1213 can, for example, include a digital signal processor that includes a matrix mixer between the analog and network audio inputs, its internal sound masking generators, (on the input side of the matrix mixer) and (on the output side) the analog and network outputs. This processor 1213 is, in turn, connected to network switches 1217, such as Power over Ethernet switches, via the multi-conductor wiring cables 1211. A standard network switch 1229 can also be present in the individually addressed sound masking network 1209. The network switches 1217 are, in turn, connected to one or more individually addressed network loudspeaker controllers 1215, which control and are connected to the individual loudspeaker assemblies 1202. The loudspeaker controllers 1215 receive power and network audio through the cables 1211 (such as a CAT-5 cable), and can, for example, receive eight audio channels. The loudspeaker controller 1215 incorporates full digital signal processing, and can route any mix of its audio channels (such as eight audio channels) to any individual addressed loudspeaker or group of the loudspeakers. In addition, each individually addressed loudspeaker 1202 has individual access to internal sound masking generators inside each loudspeaker controller 1215. The loudspeaker controller 1215 can, for example, include a digital signal processor that includes a matrix mixer between the network audio inputs, its internal sound masking generators, (on the input side of the matrix mixer) and (on the output side) the loudspeaker outputs. The individually addressed network loudspeaker controllers 1215 can, for example, be connected to the loudspeaker assembles 1202 using speaker cable 1227, such as 18-2 standard speaker cable. The individually addressed sound masking network 1209 can also include a controller 1219, such as a touch screen controller, operating software that permits a user of the system to control the individually addressed sound masking network 1209.

Figure 13:
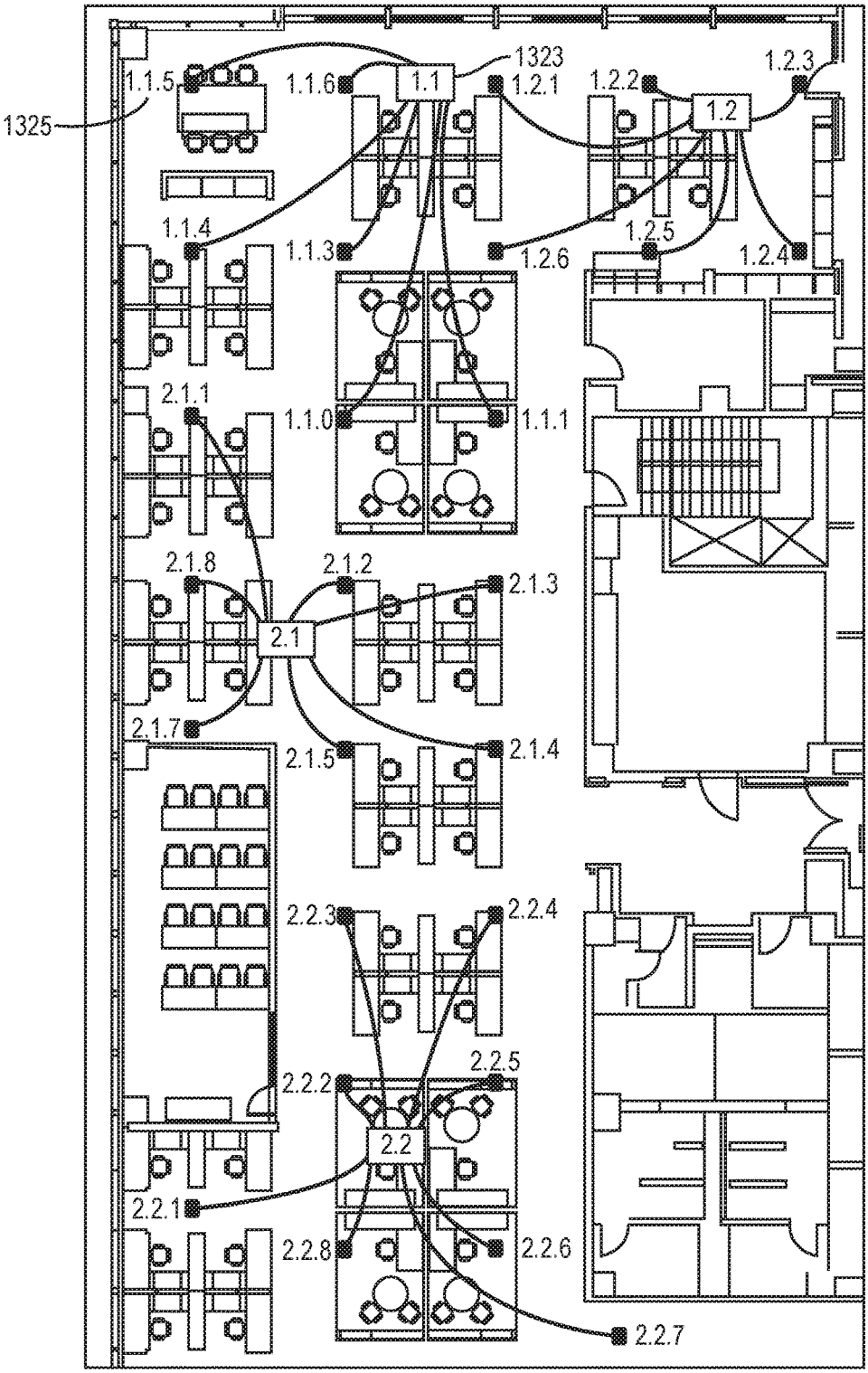
FIG. 13 is a schematic diagram illustrating the individual addressing of an individual loudspeaker assembly using the individually addressed sound masking network of FIG. 12, in accordance with an embodiment of the invention.

FIG. 13 is a schematic diagram illustrating the individual addressing of an individual loudspeaker assembly, such as 1001, 1102 or 1202 of FIGS. 10-12, using the individually addressed sound masking network of FIG. 12, in accordance with an embodiment of the invention. The schematic shows the addressing of the individual loudspeaker assemblies, overlaid on a schematic architectural drawing of the space in which sound masking is to be performed, for example an office space, at least some of which may be an open plan office space. It will be appreciated that systems herein provide a direct field sound masking system for providing a direct path sound masking signal to the ears of a listener in a predetermined area of a building, said predetermined area including a ceiling and a floor, for example the predetermined areas in the office space of FIG. 13. Here, each individually addressed network loudspeaker controller (see 1215 in FIG. 12) in the individually addressed sound masking network 1209 is assigned a unique controller address 1323 in the individually addressed sound masking network 1209, such as "1.1," for example (see FIG. 13). In turn, each individual loudspeaker assembly, such as 1001, 1102 or 1202 of FIGS. 10-12, is given a unique loudspeaker address 1325 in the individually addressed sound masking network 1209, based on the controller address 1323. For example, in FIG. 13, the loudspeakers controlled by the controller with address 1323 are assigned loudspeaker addresses 1325, such as "1.1.1," "1.1.2," "1.1.3," "1.1.4," "1.1.5" and "1.1.6." It will be appreciated that other schemes of individually addressing the loudspeakers in the individually addressed sound masking network 1209 may be used.

In this way, an embodiment according to the invention combines the flexibility of individual addressing and control of loudspeakers, with the benefits of low-directivity index, direct field sound masking. By using individual addressing of loudspeakers, an embodiment according to the invention avoids the need to have multiple loudspeakers be controlled together in sound masking zones, instead allowing the flexibility to control each individually addressed loudspeaker in the system in its own unique desired way, for optimum sound masking flexibility.

The teachings of all patents, published applications and references cited herein are incorporated by reference in their entirety.

While example embodiments have been particularly shown and described, it will be understood by those skilled in the art that various changes in form and details may be made therein without departing from the scope of the embodiments encompassed by the appended claims.

What is claimed is:

1. A direct field sound masking system for providing a direct path sound masking signal to the ears of a listener in a predetermined area of a building, said predetermined area including a ceiling and a floor, said system comprising:

a plurality of loudspeaker assemblies, each loudspeaker assembly coupled to one or more sources of an electrical sound signal, wherein each of the plurality of loudspeaker assemblies has a voice coil coupled to an audio emitter operative to emit an acoustic sound signal corresponding to said electrical sound signal, wherein each said audio emitter is a cone emitter, wherein each of the plurality of loudspeaker assemblies has a low directivity index, and wherein each of the plurality of loudspeaker assemblies is constructed and oriented to provide the acoustic sound signal in a direct path to the ears of said listener in said predetermined area;

wherein the plurality of loudspeaker assemblies are interconnected via a plurality of multi-conductor wiring cables, each multi-conductor wiring cable of the plurality of multi-conductor wiring cables comprising at least one raw power conductor and at least one electrical sound signal conductor;

wherein at least one loudspeaker assembly of the plurality of loudspeaker assemblies is electrically coupled to a power injector via at least one multi-conductor wiring cable of the plurality of multi-conductor wiring cables, the power injector being electrically connected to (i) a control module comprising the one or more sources of the electrical sound signal, and (ii) a power supply, the power injector transferring power from the power supply onto the at least one raw power conductor of the at least one multi-conductor wiring cable, and the power injector transferring the electrical sound signal from the one or more sources of the electrical sound signal onto the at least one electrical sound signal conductor of the at least one multi-conductor wiring cable; and an audio power amplifier within a loudspeaker enclosure of each loudspeaker assembly of the plurality of loudspeaker assemblies.

2. The direct field sound masking system of claim 1, wherein the electrical sound signal comprises at least one of a sound masking signal, a music signal and a paging signal.

3. The direct field sound masking system of claim 1, wherein said multi-conductor wiring cables comprise at least four pairs of conductors.

4. The direct field sound masking system of claim 3, wherein said multi-conductor wiring cables comprise four electrical sound signal conductors, two raw power conductors and two common ground conductors.

5. The direct field sound masking system of claim 1, wherein, in said plurality of loudspeaker assemblies each having a low directivity index, each said audio emitter has an effective aperture area that is less than or equal to the area of a circle having a diameter of 3.0 inches.

6. The direct field sound masking system of claim 1, wherein, in said plurality of loudspeaker assemblies each having a low directivity index, each said audio emitter has an effective aperture area that is less than or equal to the area of a circle having a diameter of 1.5 inches.

7. The direct field sound masking system of claim 1, wherein, in said plurality of loudspeaker assemblies each having a low directivity index, each said audio emitter has an effective aperture area that is equal to the area of a circle having a diameter of between 1.25 inches and 3 inches.

8. The direct field sound masking system of claim 1, wherein the loudspeaker enclosure of each loudspeaker assembly of the plurality of loudspeaker assemblies comprises a port opening from an exterior of an aperture of the loudspeaker assembly to an interior of the loudspeaker enclosure.

9. The direct field sound masking system of claim 8, wherein the port opening comprises a diameter of between about 0.3 inches and about 0.5 inches and a length of between about 1.5 inches and about 2.5 inches.

10. The direct field sound masking system of claim 1, wherein the loudspeaker enclosure of each loudspeaker assembly of the plurality of loudspeaker assemblies comprises an enclosure length of at least about 3.5 inches from an aperture face of the loudspeaker to the rear of the loudspeaker.

11. The direct field sound masking system of claim 1, wherein the loudspeaker enclosure of each loudspeaker assembly of the plurality of loudspeaker assemblies comprises an enclosure length of at least about 4.0 inches from an aperture face of the loudspeaker to the rear of the loudspeaker.

12. The direct field sound masking system of claim 1, wherein the acoustic sound signal comprises an acoustic sound masking signal comprising a corresponding sound masking spectrum, said sound masking spectrum having a low end frequency of at least about 80 Hz and a high end frequency of less than about 5300 Hz.

13. The direct field sound masking system of claim 12, wherein the sound masking spectrum comprises a frequency response of at least about 40 dB in the 125 Hz one-third octave band of the sound masking spectrum.

14. The direct field sound masking system of claim 13, wherein the sound masking spectrum comprises a frequency response of at least about 45 dB in the 125 Hz one-third octave band of the sound masking spectrum.

15. The direct field sound masking system of claim 1, wherein the sound masking spectrum comprises a frequency response that falls below about 20 dB in the range of between about 4000 Hz and about 5000 Hz of the sound masking spectrum.

16. The direct field sound masking system of claim 1, wherein the acoustic sound signal comprises a paging or music loudness of at least about 80 dBA in the covered area.

17. The direct field sound masking system of claim 1, further comprising a voltage regulator powering the audio power amplifier within the loudspeaker enclosure of each loudspeaker assembly of the plurality of loudspeaker assemblies.

18. The direct field sound masking system of claim 1, wherein each of the plurality of loudspeaker assemblies is constructed and oriented to provide the acoustic sound signal to at least one sound masking zone in the predetermined area of the building.

19. The direct field sound masking system of claim 1, further comprising a plurality of passive loudspeaker assemblies, each passive loudspeaker assembly coupled to the one or more sources of an electrical sound signal, wherein each of the plurality of passive loudspeaker assemblies lacks an audio power amplifier within a loudspeaker enclosure of each passive loudspeaker assembly of the plurality of passive loudspeaker assemblies.

20. The direct field sound masking system of claim 1, wherein at least one loudspeaker assembly of the plurality of loudspeaker assemblies further comprises an individually addressed network connector, the individually addressed network connector receiving audio signals individually addressed to the at least one loudspeaker assembly from an individually addressed sound masking network.

21. The direct field sound masking system of claim 20, wherein the individually addressed sound masking network comprises multi-conductor wiring cables that conduct both power and the individually addressed audio signals.

22. The direct field sound masking system of claim 21, wherein the multi-conductor wiring cables comprised in the individually addressed sound masking network comprise Power over Ethernet cables.

23. The direct field sound masking system of claim 20, wherein the individually addressed sound masking network comprises at least one of: an individually addressed network processor, an individually addressed network loudspeaker controller and a network switch.

24. The direct field sound masking system of claim 23, wherein the individually addressed network processor comprises a processor configured to emit electronic signals comprising at least one of: sound masking signals, paging signals and music signals.

25. The direct field sound masking system of claim 23, wherein the individually addressed sound masking network comprises an individually addressed network loudspeaker controller, and wherein at the least one loudspeaker assembly further comprises an internal loudspeaker connection directly from the individually addressed network loudspeaker controller to the voice coil of the at least one loudspeaker assembly.

26. The direct field sound masking system of claim 20, wherein the at least one loudspeaker assembly either (a) receives audio signals individually addressed to the at least one loudspeaker assembly from the individually addressed sound masking network, through the individually addressed network connector, or (b) is electrically coupled to a power injector via at least one multi-conductor wiring cable, the power injector being electrically connected to (i) a control module comprising the one or more sources of the electrical sound signal, and (ii) a power supply.

* * * * *